US005353102A

United States Patent [19]

Sato et al.

[11] Patent Number: 5,353,102

[45] Date of Patent: Oct. 4, 1994

[54] TWO COMPONENT DEVELOPING APPARATUS IN A PRINTER

[75] Inventors: Hiroshi Sato; Noriko Kawasaki, both of Kawasaki; Hiroki Oba, Fuchu, all of Japan

[73] Assignee: Fujitsu Limited, Kawasaki, Japan

[21] Appl. No.: 989,536

[22] Filed: Dec. 11, 1992

[30] Foreign Application Priority Data

Dec. 13, 1991 [JP] Japan ..... 3-330566

[51] Int. Cl.[5] ..... G03G 21/00

[52] U.S. Cl. ..... 355/246; 355/208

[58] Field of Search ..... 355/245, 246, 260, 208; 222/DIG. 1; 141/364

[56] References Cited

U.S. PATENT DOCUMENTS

| | | | |
|---|---|---|---|
| 4,237,943 | 12/1980 | Ermel et al. | 141/284 |
| 4,615,606 | 10/1986 | Nishikawa | 222/DIG. 1 |
| 4,751,484 | 6/1988 | Matsumoto et al. | 355/207 |
| 5,036,363 | 7/1991 | Iida et al. | 355/246 |
| 5,202,769 | 4/1993 | Suzuki | 355/246 X |

FOREIGN PATENT DOCUMENTS

| | | |
|---|---|---|
| 55-164846 | 12/1980 | Japan . |
| 57-130068 | 8/1982 | Japan . |
| 61-129670 | 6/1986 | Japan . |
| 3-204669 | 9/1991 | Japan . |

*Primary Examiner*—A. T. Grimley
*Assistant Examiner*—Nestor R. Ramirez
*Attorney, Agent, or Firm*—Staas & Halsey

[57] ABSTRACT

A two component developing apparatus includes a container (2a), a developing agent conveying means (20) for conveying a two component developing agent consisting of toner and carrier to an image carrier (1) from the container (2a), a mixing device (21, 22) for mixing the toner and the carrier in a toner storage section (28) of the container (2a), and a toner supplier (25) for supplying the toner in the toner storage (28) into the container (2a). The toner supplier (25) includes a toner supplying rollers (26, 27) which can vary a flow of toner per unit time and a controller (44) for controlling the supplying rollers (26, 27) on the basis of the detected flow of toner. The flow of toner per unit time at the supplying rollers (26, 27) is controlled on the basis of a consumption rate of toner. The toner supplying rollers may have cells or holes on their surface.

6 Claims, 8 Drawing Sheets

| RATE OF PRINT | TONER CONSUMPTION FOR 1 SHEET, A4 |
|---|---|
| 4% | 0.04g |
| 50% | 0.50g |
| 100% | 1.00g |

| NUMBER OF CELLS | FLOW OF TONER FOR A UNIT TIME |
|---|---|
| 10 | 0.5g/sec |
| 30 | 0.3g/sec |

TWO COMPONENT DEVELOPING APPARATUS IN A PRINTER

BACKGROUND OF THE INVENTION

1. Field of the Invention

This invention relates to a two component developing apparatus in a printer in which a toner is supplied from a toner storage unit to a developing unit.

In a printing apparatus, such as a copying machine, a printer, or a facsimile machine and the like, a printing operation is conducted in such a manner that a static latent image is first formed on a photoconductor drum by an electrophotographic system, then developed with a developing agent to form a visual image, and then transferred to a common printing sheet.

To develop the static latent image, a developing unit has been widely used. Particularly, a two component developing apparatus has been used in which two components having stable characteristics are used.

In a two component developing apparatus, it is necessary to mix the toner with the carrier, then electrify the toner, form a magnetic brush consisting of the carrier and toner on a magnetic roller and develop the static latent image on the photoconductor drum. Since the toner is consumed in the developing process, it is necessary to supply the toner.

In accordance with the recent requirements in printing techniques, i.e., a high speed printing and various mode printing, it has been required that the toner is supplied appropriately from a low rate of print to a high rate of print.

2. Description of the Related Art

A known two component developing apparatus comprises a toner container, a magnetic roller for conveying a two component developing agent to a photoconductor drum, paddle rollers for mixing the two component developing agent in the container, a blade for controlling a thickness of the developing agent formed as a layer on the magnetic roller, a flow plate for returning the developing agent which is removed from the magnetic roller by the flow plate to the paddle rollers, a toner density detecting sensor for detecting the density of toner in the container.

The above-mentioned known two component developing apparatus has also a toner hopper (toner supplying means) which comprises a toner cartridge containing the toner, and a toner supplying roller (sponge roller) for supplying the toner in the toner cartridge to the container. The sponge roller has a number of cells (holes).

In the toner hopper, the sponge roller is rotated so that the toner which enters into the cells of the sponge roller falls down into the container and a part of the toner is scraped by a case of the toner hopper and supplied into the container.

Such a toner supply is conducted by rotating the sponge roller in accordance with the output of the toner density sensor or rotating the sponge roller at a constant time interval. The sequence of the sponge roller, such as, the number of cells, the revolutional speed, the gaps between the cells, and the like are determined a standard amount of toner consumed at a standard printing rate, such as, in printing letters (for example, a printing rate: 4–5% in a A4 sized printing sheet). Consequently, the toner supply flow or consumption per unit time is constant.

However, the above-mentioned conventionally known two component developing apparatus has the following drawbacks.

(1) Recently, it is required to print at a high printing density (i.e., rate of print) in, for example, image printing. Therefore, if a printing operation at a high print density (for example, 70–80%) is continued, the toner consumption per a unit time will be increased. Thus, the toner is not supplied enough to the container and therefore the toner will be sufficient, so that the print density will be reduced.

(2) On the contrary, if the toner supply flow per unit time is increased, when the rate of print is low, the toner supply flow will be too much so that the non-electrified toner will increase due to the excess toner supply. Thus, a dark print will occur.

SUMMARY OF THE INVENTION

Accordingly, an object of the present invention is to provide a two component developing apparatus in which a stable printing density can be obtained regardless of a change in the rate of print.

Another object of the present invention is to provide a two component developing apparatus in which a balance between the rate of print and stability in the toner density can be kept to a region of high rate of print.

According to the present invention, there is provided a two component developing apparatus in an image forming apparatus, said apparatus comprising a container, a developing agent conveying means for conveying two component developing agent including toner and carrier to an image carrier from the container, mixing means for mixing the toner and the carrier in a toner storage section of the container, and a toner supplying means for supplying the toner in the toner storage into the container, characterized in that the toner supplying means comprises a toner supplying section which can vary a flow of toner per unit time and a controlling means for controlling the toner supplying section on the basis of the detected flow of toner, so that the flow of toner per unit time at the toner supplying section is controlled on the basis of a consumption rate of toner.

In the present invention, the flow of toner per a unit time at the toner supplying section can be controlled on the basis of the consumption rate of toner in such a manner that, if the rate of print is high, the flow of toner is to be increased and if the rate of print is low, the flow of toner is to be reduced. Thus, an excess toner supply can be avoided and the toner density can be controlled stably from a high print rate to a low print rate.

DESCRIPTION OF THE PREFERRED EMBODIMENTS

Figure 1:
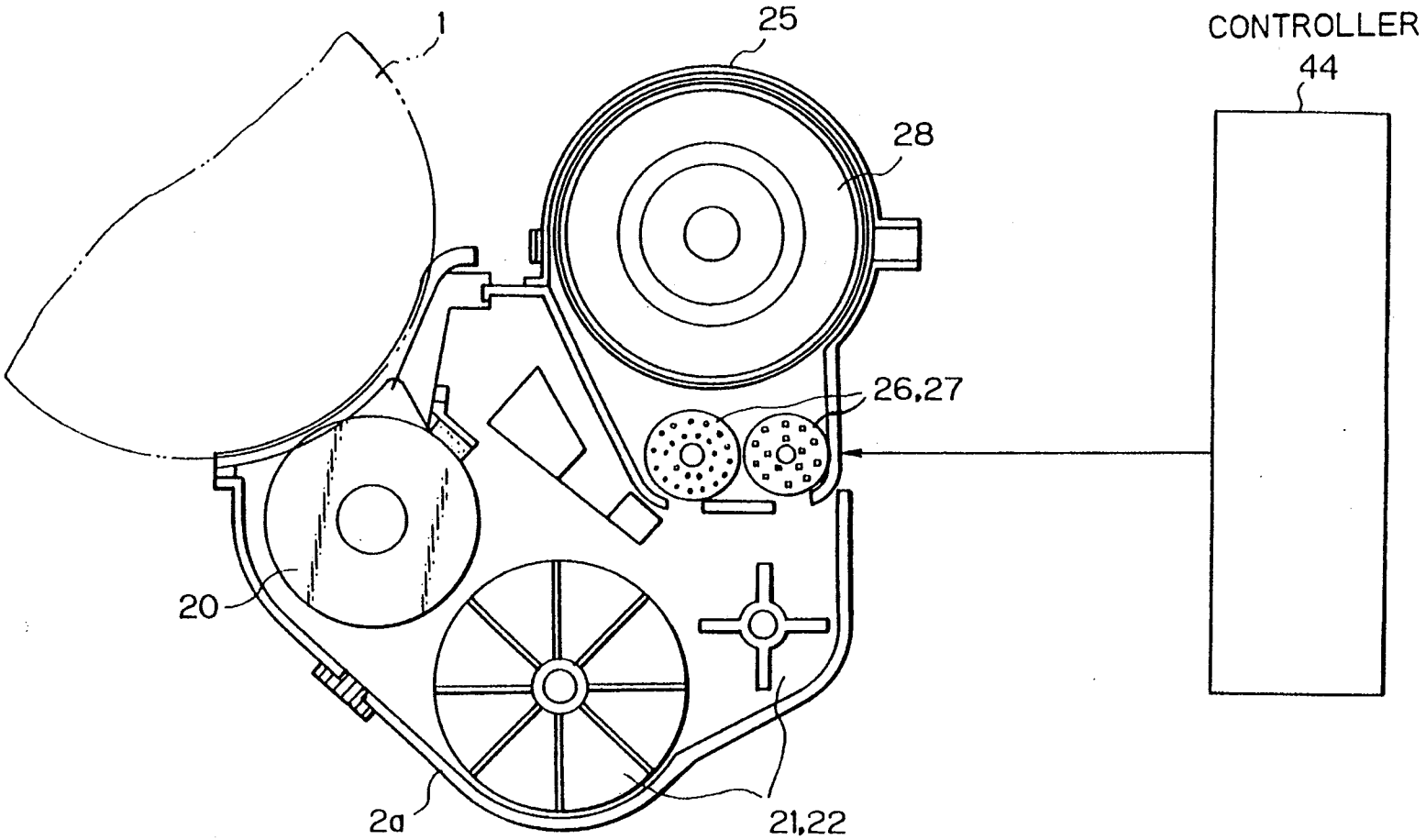
FIG. 1 is a schematic view illustrating a principle of a two component developing apparatus according to the present invention.

Referring now to the drawings, FIG. 1 is a schematic diagram illustrating a principle of the present invention. The present invention comprises a container 2*a*, a developing agent conveying means 20 for conveying a two component developing agent including toner and carrier to an image carrier 1 from the container 2*a*, mixing means 21 and 22 for mixing the toner and the carrier in a toner storage 28 of the container 2*a*, and a toner supplying means 25 for supplying the toner in the toner storage 28 into the container 2*a*. According to the present invention, the toner supplying means 25 comprises a toner supplying section (26 and 27) which can vary a flow of toner per unit time and a controlling means 44 for controlling the toner supplying section (26 and 27) on the basis of the detected flow of toner, so that the flow of toner per unit time at the toner supplying section (26 and 27) can be controlled on the basis of the consumption rate of toner.

Thus, the flow of toner per unit time at the toner supplying section (26 and 27) can be controlled on the basis of the consumption rate of toner in such a manner that, if the rate of print is high, the flow of toner is to be increased and, if the rate of print is low, the flow of toner is to be reduced. Thus, an excess toner supply can be avoided and the toner density can be controlled stably from a high rate of print to low rate of print.

According to an embodiment of the present invention, the toner supplying section (26 and 27) comprises a plurality of supply rollers 26 and 27 which can be driven independently in such a manner that the above-mentioned controlling means 44 selectively drives the supply rollers 26 and 27.

Therefore, depending on the selection of the supply rollers 26 and 27, the flow of toner per unit time can be controlled and thus a simple structure can be attained in the same sequence as the conventional one.

According to another embodiment of the present invention, the plurality of supply rollers 26 and 27 have different sized cells, respectively. Thus, the toner supply rate per unit time can easily be changed.

The plurality of supply rollers 26 and 27 are arranged in parallel. Thus, the toner can be uniformly supplied in the axial direction. Such a structure can also be attained only by adding the supply rollers.

Contrary, the plurality of supply rollers 26 and 27 can be arranged in series. Thus, such a structure can be attained only by changing the the supply roller without changing the structure of the developing means 2.

According to a still another embodiment of the present invention, a dot counter 43 is provided for counting the number of print dots of video signals for driving a latent image forming means 11 of the image carrier 1. Thus, the toner consumption rate can accurately be detected, so that the toner supply rate can be controlled precisely.

According to a further embodiment of the present invention, a toner density detecting means 29 is provided for detecting the density of toner in the container 2*a* and the above-mentioned controlling means 44 determines the consumption rate of toner from the detected value of the toner density detecting means 29. Thus, the consumption rate of toner can be detected by a simple construction and therefore the supply control of toner can simply be attained.

(a) First Embodiment

Figure 2:
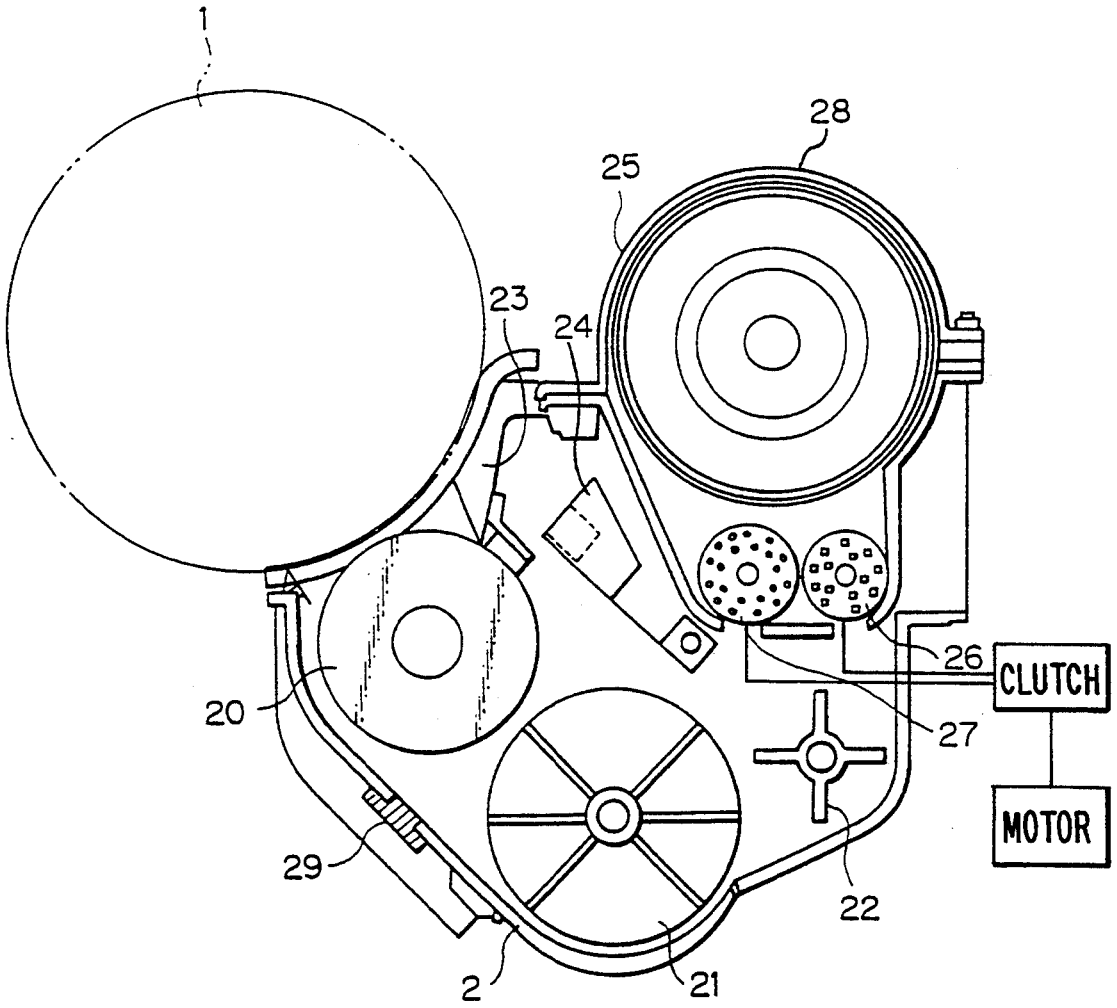
FIG. 2 is a cross-sectional view of the first embodiment of a two component developing apparatus of this invention.
Figure 3:
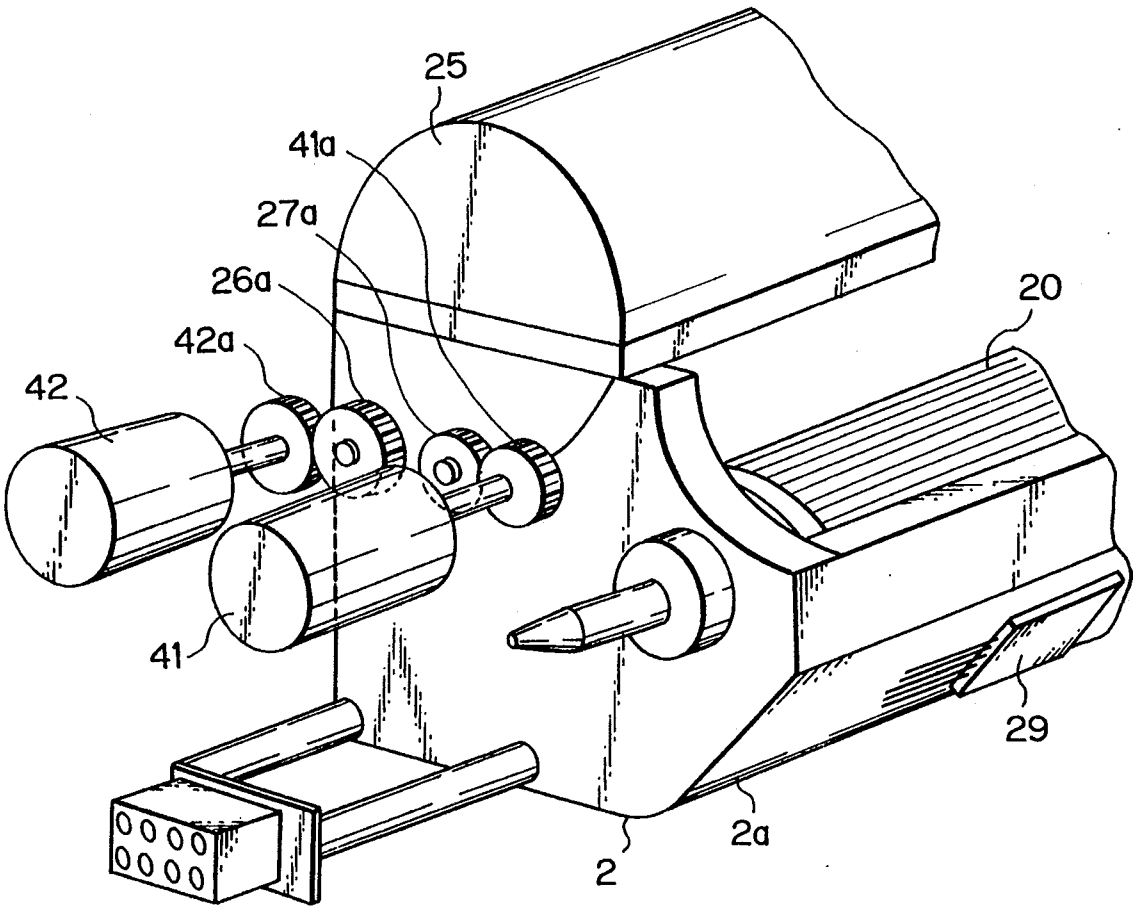
FIG. 3 is a perspective view illustrating a main part of the first embodiment.

FIG. 2 illustrates a construction of an embodiment of an electronic photographic printer of the present invention; FIG. 3 is a perspective view of the main part of the embodiment shown in FIG. 2; and FIG. 4 is a block diagram of the first embodiment of the electronic photographic printer.

In these drawings, the same or corresponding parts are indicated by the same reference numerals as those in FIG. 1. Referring now to FIG. 2, the reference numeral 26 generally indicates a first sponge roller having a relatively smaller number of cells each having a relatively larger sized hole, for supplying a relatively larger amount of toner, and the reference numeral 27 indicates a second sponge roller having a relatively larger number of cells each having a relatively smaller sized hole, for supplying a relatively smaller amount of toner. These sponge rollers 26 and 27 are arranged at an outlet of the toner hopper 25. Therefore, the toner hopper 25 has two toner supply ports for the first and second sponge rollers 26 and 27, respectively.

As shown in FIG. 3, at the side of the container 2*a*, gears 26*a* and 27*a* are mounted on shafts of the first and second sponge rollers 26 and 27, respectively, which are engaged with drive gears 41*a* and 42*a* of toner supply motors 41 and 42, respectively. Therefore, the first and second sponge rollers 26 and 27 can be independently driven to each other by the toner supply motors 41 and 42, respectively.

Figure 4:
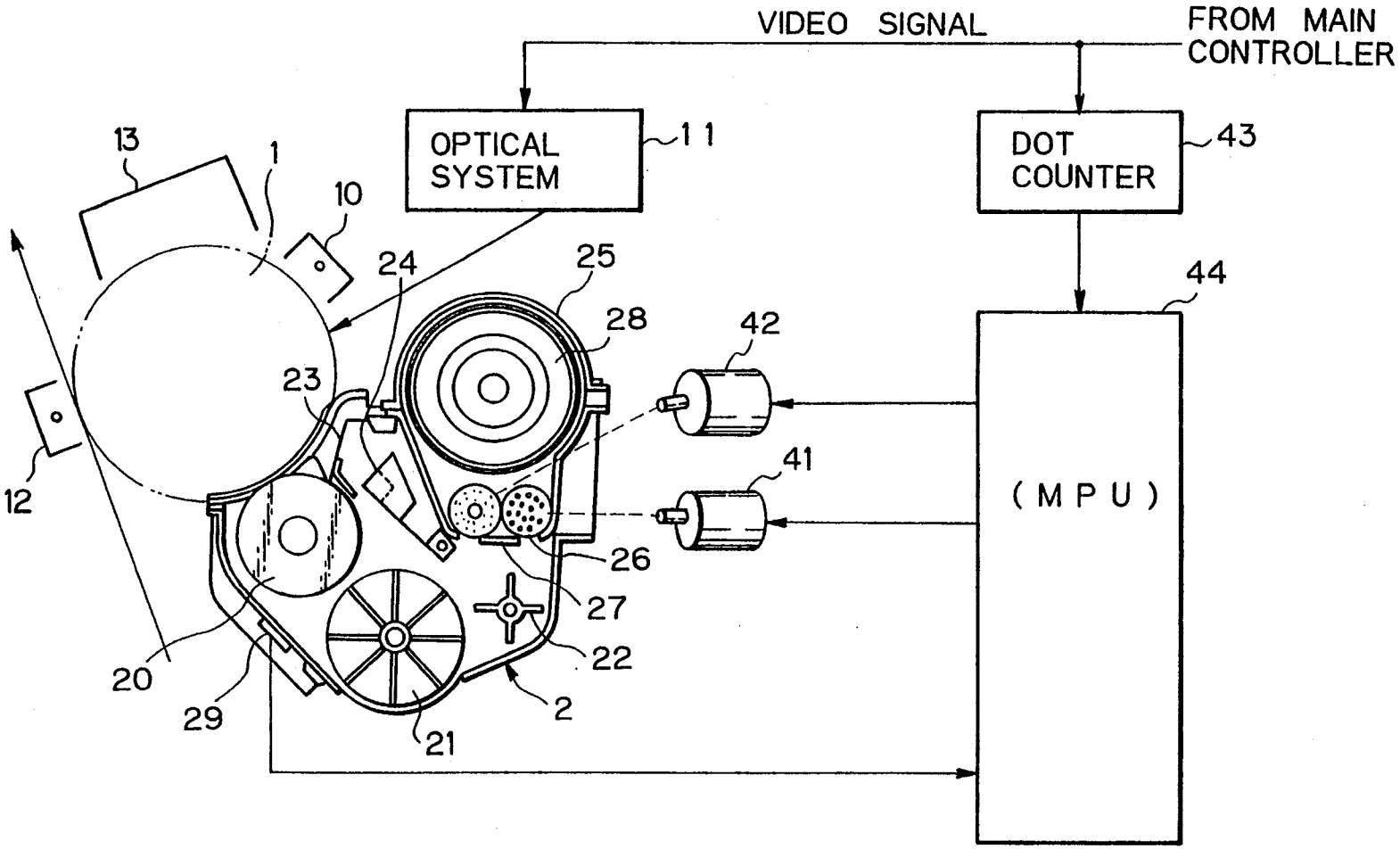
FIG. 4 is a block diagram of the first embodiment.

In FIG. 4, an electrification unit 10 is provided for charging a photoconductor drum 1. A line exposure is conducted onto the photoconductor drum 1 by means of a laser optical system 11 in accordance with a video signal from a main controller (not shown), so that a light image is formed on the photoconductor drum 1. A transfer/separation unit 12 transfers the toner image on the photoconductor drum 1 to a print sheet and separates the print sheet from the photoconductor drum 1. A cleaner 13 is provided for cleaning the photoconductor drum 1.

A dot-counter 43 is provided for counting the number of black dot signals of the video signal per one page. A mechanical controller 44 is constituted by a microprocessor in which a process such as shown in FIG. 5 is conducted in such a manner that a rate of print is determined on the basis of the count value C in the dot-counter 43 and the toner supply motors 41 and 42 are controlled and driven, so that the toner density is microcontrolled and also the other mechanisms are controlled in accordance with the output of the toner density sensor 29.

Figure 5:
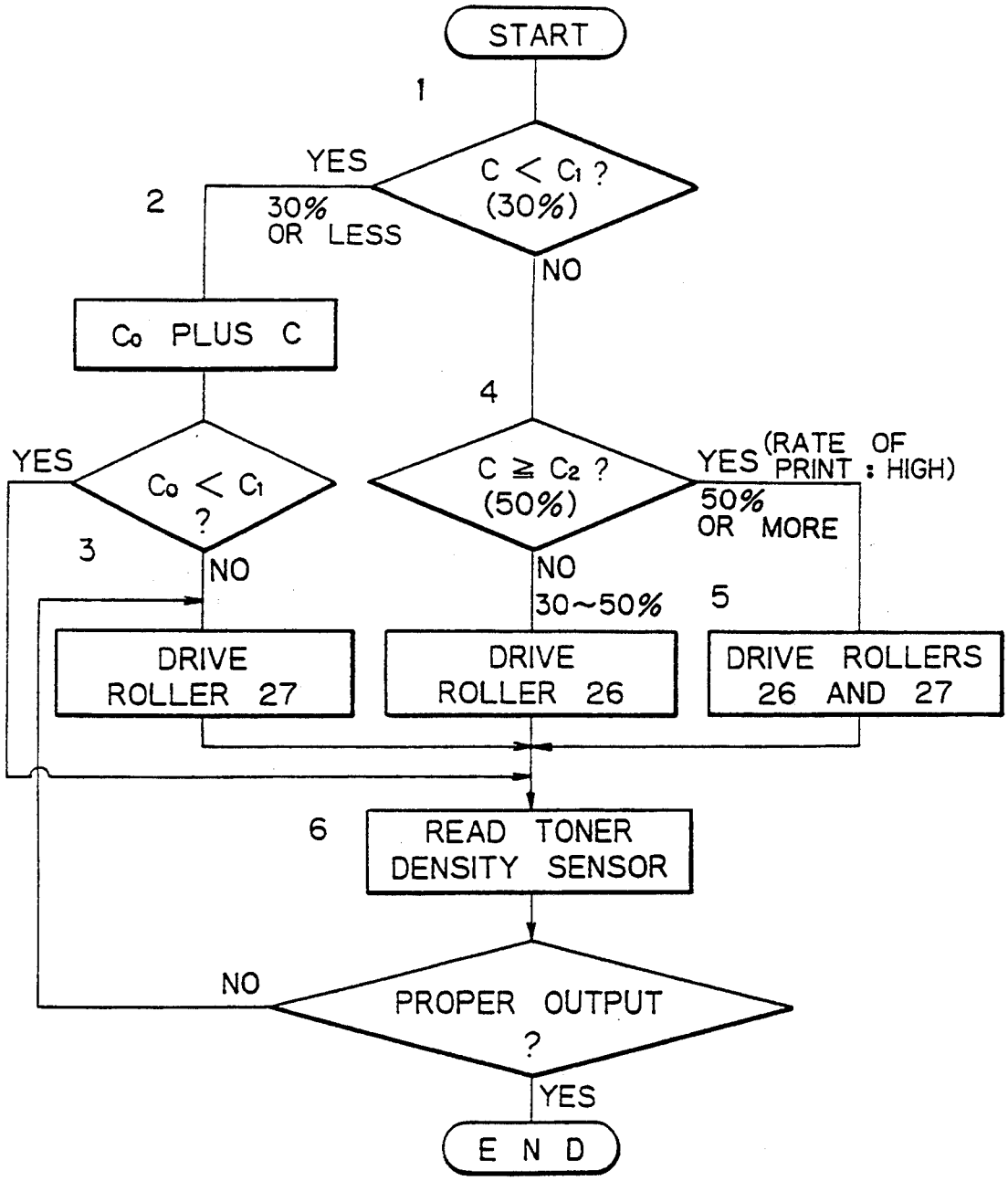
FIG. 5 is a flow diagram illustrating a toner supplying process in the first embodiment.
Figures 6A, 6B, 6C:
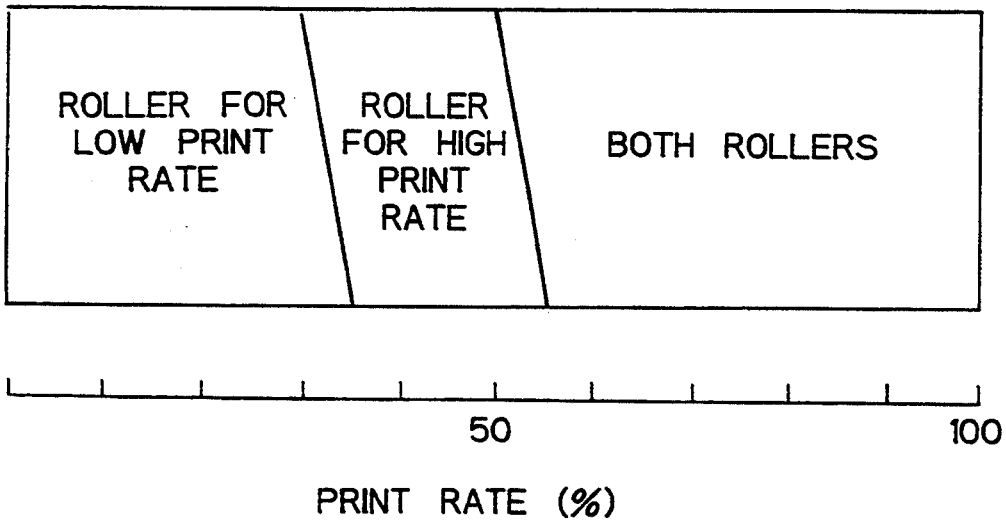
FIGS. 6(A), 6(B) and 6(C) are diagrams illustrating operation in the first embodiment.

FIG. 5 is a flow chart of the toner supplying process of the first embodiment according to the present invention, and FIGS. 6(A)–(C) show an operation of the first embodiment.

Step (1)

The controller 44 reads on the dot-count value C per one page in the dot counter 43 and compares the dot-count value C with a count value C1 corresponding to 30% (the rate of print).

Step (2)

If the dot-count value C is smaller than C1, i.e., the rate of print is low (lower than 30%), a dot-count value C is added to the count value C0 and then the value is compared with the count value C1.If the count value C0 is lower than C1,the consumption of toner is very low and, therefore, the controller 44 advances to a step (6).

Step (3)

If the controller 44 determines that the count value C0 is larger than C1, the toner supply motor 42 is driven to rotate the sponge roller 27 so that the toner is supplied to the container 2a at a lower flow per unit time and, then, the process advances to the step (6).

Step (4)

On the other hand, in the step (1), if the dot-count value C is larger than C1, in a step (4), the controller 44 compares the dot-count value 44 with a count value C2 corresponding to 50% (rate of print). If the dot-count value C is not more than C2, i.e., the rate of print is 30–50%), the toner supply motor 41 is driven to rotate the sponge roller 26 so that the toner is supplied to the container 2a at a relatively higher flow per unit time and, then, the process advances to the step (6).

Step (5)

If the dot-count value C is more than C2, i.e., the rate of print is relatively high, i.e., over 50%, the controller 44 instructs to drive the toner supply motors 41 and 42 to rotate the sponge rollers 26 and 27, respectively, so that the toner is supplied to the container 2a at a higher flow per unit time and, then, the process advances to the step (6).

Step (6)

The controller 44 reads the detected output of toner density from the toner density sensor 29 and determines whether the toner density is appropriate or not. If not appropriate, the process returns to the step (3) to drive the toner supply motor 42 to rotate the sponge roller 27, so that the toner is supplied to the container 2a at a relatively lower flow per a unit time until the density value reaches to an appropriate value. If appropriate, the process ends.

The process will now be described with reference to FIGS. 6(A)–(C). In FIG. 6(A), the toner consumption per one page, A4 size, is 0.04 g if the rate of print is 4%, 0.50 g if the rate of print is 50%, and 1.00 g if the rate of print is 100%.

As shown in FIG. 6(B), the sponge roller 26 has ten cells and the toner supply flow per a unit time is 0.5 g/sec. On the other hand, the sponge roller 27 has 30 cells and the toner supply flow per unit time is 0.3 g/sec.

Therefore, assuming that the printing machine is a high speed type in which the time from start to end of a printing operation for one page, A4 size, is not more than 1 sec. As shown in FIG. 6(C), if the rate of print in a previous printing operation is more than 50%, the toner is supplied by both the sponge rollers 26 and 27 during the printing operation for supplying the toner so as to comply with the toner consumption, because the toner supplied by only the sponge roller 26 at a toner consumption of 0.50 g until the start of the next printing operation would not be enough.

If the rate of print in a previous printing operation is not more than 30%, i.e., if the toner consumption is not over 0.03 g, the toner supplied by the sponge roller 27 will thus be stopped. Because, if the sponge roller 27 is rotated, excessive toner would probably be supplied. Consequently, the toner supply is controlled in accordance with the detected output of the toner density sensor 29 in such a manner that, if the rate of print per more than two pages becomes more than 30%, the toner will be supplied by the sponge roller 27.

If the rate of print in the previous printing operation is 30 to 50%, i.e., if the toner consumption is in the range of 0.30 to 0.50 g, the toner is supplied by the sponge roller 26.

Thus, the toner supply per unit time is changed in accordance with the toner consumption, i.e., the rate of print, in such a manner that, if the rate of print is high, the toner supply is increased so as to finish the supply of toner until the next printing operation and, if the rate of print is low, the amount of toner supplied is reduced so as to prevent an excess supply of toner and also to prevent a generation of "dark" print, so that the rate of print is kept constant.

In this embodiment, since the supply rollers 26 and 27 are used, a conventional toner hopper 25 can be used without making any alteration and without changing any printing sequences. Also, since these rollers are sponge rollers 26 and 27, the toner supply flow can easily be changed by merely changing the number of cells.

In addition, since the sponge rollers 26 and 27 are arranged in parallel, the construction of rollers can easily be achieved with less expensive. Also, since the count value from the dot-counter 43 is used, a precise rate of print, i.e., the toner consumption, can be measured. Moreover, the print density can be precisely kept constant, since it is micro-controlled in accordance with the output from the toner density sensor 29.

(b) Second Embodiment

Figure 7A:
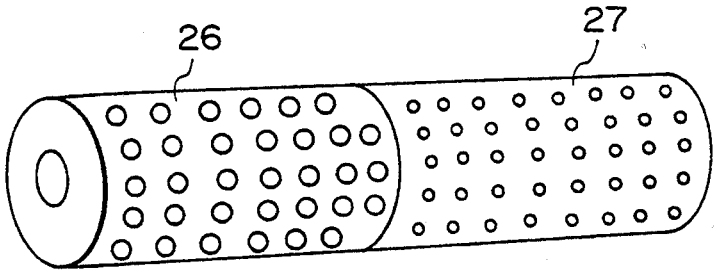
FIGS. 7(A), 7(B), 7(C) and 7(D) illustrate a toner supply roller in a second embodiment of a two component developing apparatus of this invention.

FIGS. 7(A)–7(D) illustrates a second embodiment of the present invention. The construction of this embodiment is substantially the same as that described with reference to FIGS. 2 to 4. The process is also substantially the same as that described with reference to FIG. 5. As shown in FIG. 7(A), this embodiment differs from the previous embodiment in that the toner supply rollers 26 and 27 are arranged in series, and are driven by a single toner supply motor 42.

Figure 7B:
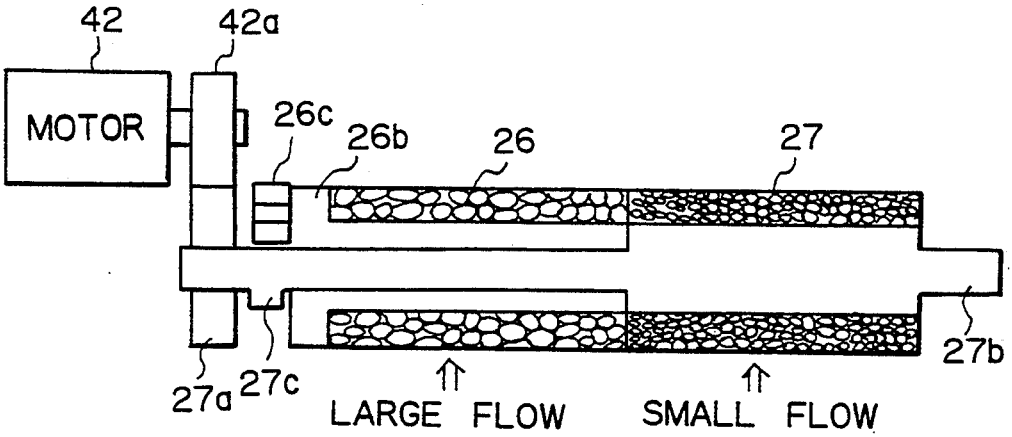

As shown in FIG. 7(B), a drive force is transmitted from the toner supply motor 42 via a drive gear 42a thereof and a gear 27a to a shaft 27b of the sponge roller 27 for a small flow supply. The diameter of the shaft 27B is partially reduced, on which part a shaft 26b of the sponge roller 26 for large flow supply is mounted.

Figure 7C:
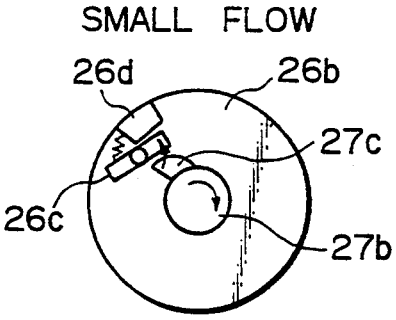

As shown in FIGS. 7(B) and 7(C), the shaft 27b is provided with a drive projection 27c having an inclination. Also, as shown in FIG. 7(C), the shaft 27b is provided with a projection 26d and a swing arm 26c. Thus, as shown in FIG. 7(C), if the shaft 27b rotates in the clockwise direction, the swing arm 26c turns in the counterclockwise direction by means of the drive projection 27c and thus the shaft 26b does not rotate, but only the shaft 27b rotates, i.e., only the sponge roller 27 for a small flow supply rotates, so that the toner supply per unit time can be small.

Figure 7D:
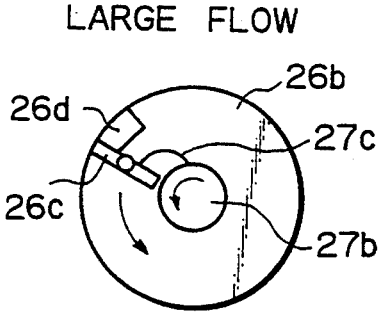

On the other hand, as shown in FIG. 7(D), if the shaft 27b rotates in the counterclockwise direction, the swing arm 26c turns in the clockwise direction by means of the drive projection 27c to push the projection 26d and thus the shaft 26b rotates with the shaft 27b, i.e., both the sponge roller 26 for a large flow supply and the sponge rollers 27 for a small flow supply rotate, so that the toner supply per unit time can be increased.

According to this structure, a roller drive system substantially the same as a conventional one can be used without changing the toner hopper 25 of the developing unit 2. It is only necessary to change the rollers and set the rollers on the conventional structure of the printing machine.

(c) Third Embodiment

Figure 8A:
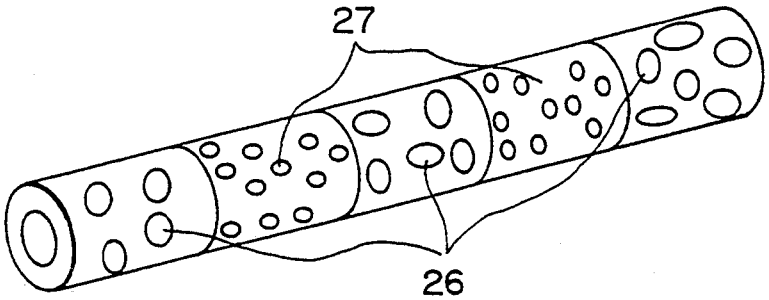
FIGS. 8(A) and 8(B) illustrate a toner supply roller in a third embodiment of a two component developing apparatus of this invention.

FIGS. 8(A) and (B) illustrate a third embodiment of the present invention. The construction of this embodiment is substantially the same as that described with reference to FIGS. 2 to 4. The process is also substantially the same as that described with reference to FIG. 5. However, as shown in FIG. 8(A), this embodiment differs from the second embodiment in that a plurality of toner supply rollers 26 and 27 are alternately arranged in series.

Figure 8B:
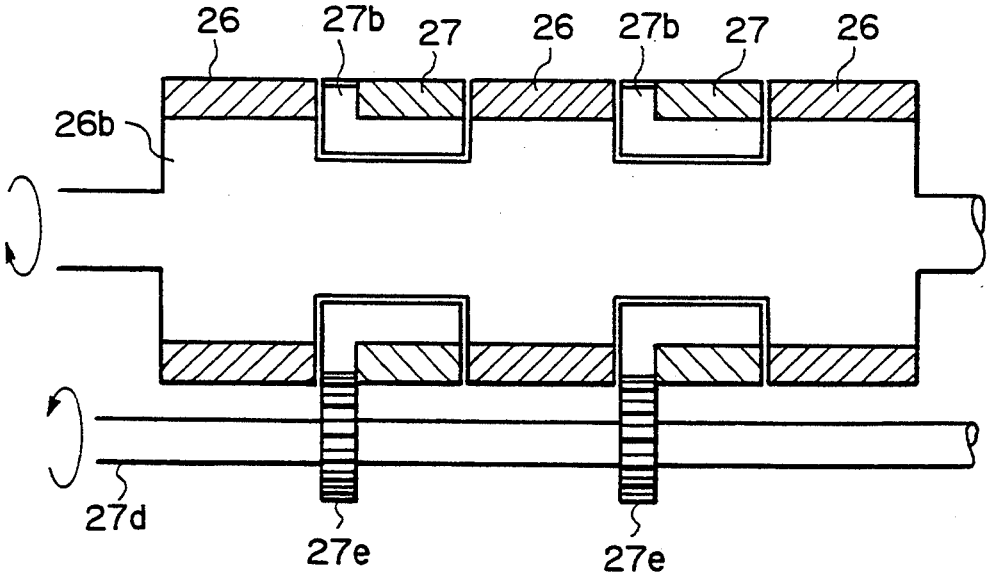

In this embodiment, as shown in FIG. 8(B), the shaft **26*b* of the sponge roller 26 for a large flow supply is provided with parts which are reduced in the diameter thereof, on which parts the sponge rollers 27 for a small flow supply and their shafts 27*b* are mounted. Also, another part of each of the shafts 27*b*** is formed with a gear.

A drive shaft **27*d* is provided to drive the roller 27 for a small flow supply. The drive shaft 27*d* has drive gears 27*e* which engage with gears formed on the shafts 27*b* of the rollers 27 for a small flow supply. Thus, if the shaft 26*b* is rotated, only the sponge rollers 26 for large flow supply are rotated, so that the toner supply per unit time is increased. If the shaft 27*d* is rotated, the shaft 27*b* of the rollers 27 for small flow supply is rotated by the gears 27*e* and therefore only the sponge rollers 27** for small flow supply are rotated, so that the toner supply per unit time can be reduced.

Of course, if both the shafts **26*b* and 27*d* are rotated, both the sponge rollers 26 and 27** for small and large flow supplies are rotated, so that the toner supply per unit time is further increased.

In this embodiment, although two motors are necessary for both shafts **26*b* and 27*d*, a single motor may be used by applying a clutch means for selectively driving the shaft 26*b* or 27*d*. Otherwise, in the same manner as the second embodiment, a single motor may be directly connected to one of the shafts 27*d* and 26*b* to drive the same, so that the other shaft 26*b* or 27*d*** may be driven via a clutch means.

According to this structure, even if the rollers can be arranged in series or either one of the rollers 26 or 27 is rotated, the toner can be supplied uniformly in the axial direction and, therefore, the toner supply is prevented from being uneven in the axial direction to prevent a change in print density in the width direction of the printing sheet.

(d) Other Embodiments

In addition to the embodiments mentioned above, the following modifications can also be made.

(1) In the first embodiment, although two toner supply motors are provided for the respective rollers as shown in FIG. 3, only one toner supply motor may be provided to drive the respective roller shafts by use of a clutch means.

(2) In the second or third embodiment, the arrangement of the sponge rollers 26 and 27 for small and large flow supplies may be reversed.

(3) In the second embodiment, two toner supply motors may be provided for the respective rollers, or only one toner supply motor may be provided to drive the respective roller shafts by use of a clutch means.

(4) In the respective embodiments, the number of cells may be the same for a plurality of rollers, but the number of rollers may be changed so as to change the toner supply flow per unit time.

(5) In the embodiments, although the rate of print is determined by a count value of the dot counter, the rate of print may be determined by a change of the detected output of the toner density sensor. Otherwise, if a toner mark is used, the rate of print may be obtained from the output of the detected value thereof.

(6) In the embodiments, although the image carrier 1 is a photoconductor drum, the other means, on which a latent image is formed, may be used, such as, a dielectric body which is used in an electrostatic recording apparatus.

It should be understood by those skilled in the art that the foregoing description relates to only preferred embodiments of the disclosed invention, and that various changes and modifications may be made to the invention without departing from the spirit and scope thereof.

We claim:

1. A two component developing apparatus for an image forming apparatus, said apparatus comprising:

a container, a developing agent conveying means for conveying a two component developing agent including toner and carrier to an image carrier from the container, mixing means for mixing the toner and carrier in the container, toner supply means for supplying the toner to the container and varying the flow of toner from a toner storage section per unit of time, the toner supplying means comprising a plurality of supply rollers which are driven independently from each other and arranged in series on a single axis, the plurality of supply rollers supplying different quantities of toner per unit time and comprising a plurality of first supply rollers and a plurality of second supply rollers, each of the first and second supply rollers having a number of cells or holes, whose sizes are different from each other of the toner supply rollers, the first and second supply rollers being arranged alternately on a single axis, control means for selectively driving the supply rollers on the basis of the detective flow of toner, so that the flow of toner per unit time from the toner storage section is controlled on the basis of a consumption rate of toner.

2. A two component developing apparatus as claimed in claim 1, wherein the plurality of first supply rollers are fixedly mounted on a single shaft and the plurality of second supply rollers are rotatably mounted on the shaft.

3. A two component developing apparatus as claimed in claim 1, wherein the second supply rollers are fixedly secured to respective gears which are engaged with drive gears mounted on a drive shaft.

4. A two component developing apparatus as claimed in claim 1, wherein a dot counter is provided for counting the number of print dots of video signals for driving a latent image forming means of the image carrier.

5. A two component developing apparatus as claimed in claim 1, wherein a toner density detecting means is provided for detecting the density of toner in the container and said control means determines the consumption rate of toner from the value detected by the toner density detecting means.

6. A two component developing apparatus as claimed in claim 1, wherein the plurality of supply rollers are arranged in parallel.

* * * * *